US008362345B1

(12) United States Patent
Rice

(10) Patent No.: US 8,362,345 B1
(45) Date of Patent: Jan. 29, 2013

(54) MUSICAL INSTRUMENT ACCESSORIES AND METHODS FOR USING SAME

(76) Inventor: Brad Rice, Spokane, WA (US)

( * ) Notice: Subject to any disclaimer, the term of this patent is extended or adjusted under 35 U.S.C. 154(b) by 14 days.

(21) Appl. No.: 13/034,078

(22) Filed: Feb. 24, 2011

Related U.S. Application Data

(60) Provisional application No. 61/308,252, filed on Feb. 25, 2010.

(51) Int. Cl.
*G10D 3/00* (2006.01)

(52) U.S. Cl. ..... 84/327; 248/443

(58) Field of Classification Search ..... 84/327
See application file for complete search history.

(56) References Cited

U.S. PATENT DOCUMENTS 414,231 A * 11/1889 Loring ..... 206/14
527,694 A * 10/1894 Jones ..... 248/465
812,993 A * 2/1906 Harper ..... 248/459
1,056,183 A * 3/1913 Kislovitz ..... 248/459
1,303,306 A * 5/1919 Heithaus ..... 248/459
1,359,662 A * 11/1920 Blyth ..... 40/748
2,072,167 A * 3/1937 Graham ..... 40/726
2,133,356 A * 10/1938 Luttbeg ..... 84/376 A
2,419,823 A * 4/1947 Cross et al. ..... 40/753
2,553,174 A * 5/1951 Cross ..... 248/459
2,888,764 A * 6/1959 Knox ..... 40/732
3,113,559 A * 12/1963 Friedman ..... 211/69.9
3,355,828 A * 12/1967 Betz ..... 40/750
3,371,570 A * 3/1968 Lester ..... 84/327
3,866,877 A * 2/1975 Thompson ..... 248/688
4,084,477 A * 4/1978 Dominguez ..... 84/327
4,213,369 A * 7/1980 Swartwout ..... 84/284
4,291,798 A * 9/1981 Transport ..... 206/45.24
4,592,265 A * 6/1986 Steinberger ..... 84/327
4,622,767 A * 11/1986 Sullivan ..... 40/120
4,656,917 A * 4/1987 Van Halen ..... 84/327
4,693,161 A * 9/1987 Uhrig ..... 84/327
5,197,701 A * 3/1993 Olson ..... 248/166
5,234,190 A * 8/1993 Cross ..... 248/459
6,014,829 A * 1/2000 Wilson et al. ..... 40/753
6,130,375 A * 10/2000 Kellogg et al. ..... 84/327
6,145,801 A * 11/2000 Herring, Jr. ..... 248/463
6,163,998 A * 12/2000 James ..... 40/755
6,422,522 B1 * 7/2002 Woollen ..... 248/166
6,441,283 B1 * 8/2002 Scott ..... 84/327
6,573,439 B2 * 6/2003 Wilson ..... 84/291
6,603,067 B1 * 8/2003 Woollen ..... 84/327
6,672,549 B2 * 1/2004 Kolb ..... 248/127
D491,733 S * 6/2004 Manrique ..... D6/310
7,208,666 B2 * 4/2007 Burch et al. ..... 84/327
D579,493 S * 10/2008 Miyaji ..... D19/1
8,063,291 B2 * 11/2011 Crowder et al. ..... 84/327
8,162,282 B2 * 4/2012 Hu et al. ..... 248/447
2004/0007117 A1 * 1/2004 Howard, Sr. ..... 84/327

(Continued)

*Primary Examiner* — David Warren
*Assistant Examiner* — Robert W Horn
(74) *Attorney, Agent, or Firm* — Wells St. John P.S.

(57) ABSTRACT

Musical instrument accessories are provided that can include a substantially planar board at least partially complimenting the rear face of the musical instrument. A portion of the board can define at least one substantially planar leg coupled to the board and moveable between at least two positions with respect to the board, the first position wherein the leg is received within the board to complete the board, and the second position wherein the leg is extended from the board to form a support for the musical instrument. The accessory can also include one or more adhesion elements along one side of the board. Methods for supporting a musical instrument are provided that can include adhering the board to a rear face of a musical instrument, storing the musical instrument in a case with the leg in the first position, and supporting the musical instrument with the leg in the second position.

8 Claims, 10 Drawing Sheets

U.S. PATENT DOCUMENTS

2004/0182984 A1* 9/2004 Sandkuhl ..... 248/443
2008/0290240 A1* 11/2008 Stievenard et al. ..... 248/450
2011/0219935 A1* 9/2011 Amland ..... 84/327

* cited by examiner 10
20
16
41

11A, B
18
42
40

50
20
14
12
16

MUSICAL INSTRUMENT ACCESSORIES AND METHODS FOR USING SAME

CROSS REFERENCE TO RELATED APPLICATION

This application claims priority to U.S. Provisional Patent Application Ser. No. 61/308,252 which was filed on Feb. 25, 2010, the entirety of which is incorporated by reference herein.

TECHNICAL FIELD

The present disclosure relates generally to musical instrument accessories and methods of using same. Particular embodiments of the disclosure relate to guitar stands and protective accessories and methods of using same.

BACKGROUND

Musical instruments, particularly string instruments, typically have a sound producing body. These bodies can be quite beautiful and in fact by their very nature are delicate. It is important to the owners and users of these instruments that the bodies be protected, both the frontal appearance and the rear appearance. To facilitate such protection, owners/users store their instruments in cases or support their instruments with stands.

Problematically, stands can be difficult to transport and/or may take up much needed space while not in use. Further, stands that have been attached to the instrument can prevent the instrument from thereafter being stored in a case. The present disclosure provides instrument accessories and methods that can, according to certain embodiments, protect the appearance of these bodies while in use and/or in storage.

SUMMARY

Musical instrument accessories are provided that can include a substantially planar board at least partially complimenting the rear face of the musical instrument. A portion of the board can define at least one substantially planar leg coupled to the board and moveable between at least two positions with respect to the board, the first position wherein the leg is received within the board to complete the board, and the second position wherein the leg is extended from the board to form a support for the musical instrument. The accessory can also include one or more adhesion elements along one side of the board.

Methods for supporting a musical instrument are provided that can include adhering the board to a rear face of a musical instrument, storing the musical instrument in a case with the leg in the first position, and supporting the musical instrument with the leg in the second position.

DRAWINGS

Embodiments of the disclosure are described below with reference to the following accompanying drawings.

DESCRIPTION

This disclosure is submitted in furtherance of the constitutional purposes of the U.S. Patent Laws "to promote the progress of science and useful arts" (Article 1, Section 8).

The musical instrument accessories and musical instrument protective methods will be described with reference to FIGS. 1-11B.

Figure 1:
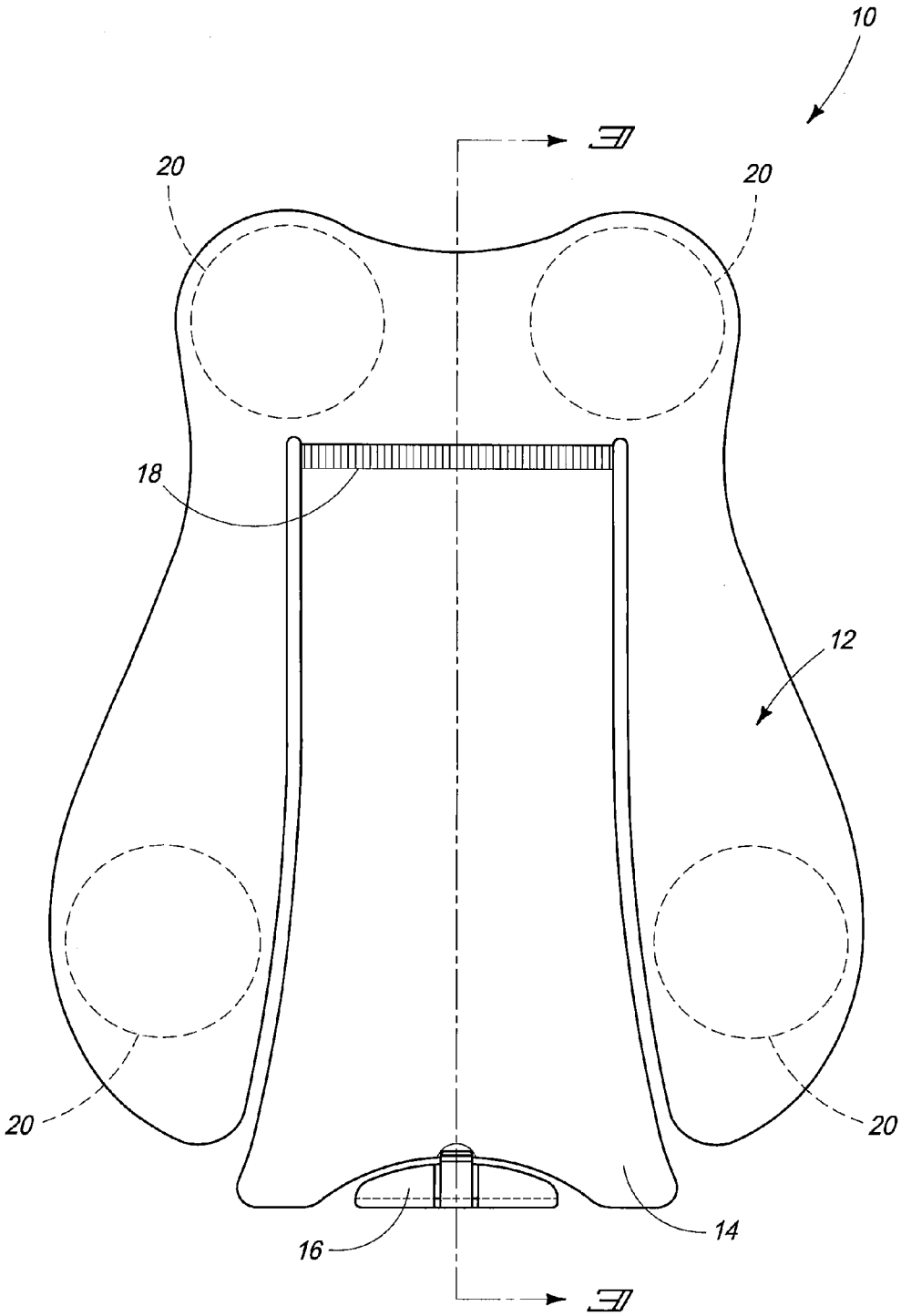
FIG. 1 is a musical accessory according to an embodiment.

Referring first to FIG. 1, a musical accessory 10 according to an embodiment is shown having a backing 12 that is coupled to a stand portion 14 via hinge 18. Backing 12 can be a substantially planar board. In accordance with example implementations, the board can at least partially compliment the rear face of the musical instrument. The board can define a perimeter and at least a portion of the perimeter can include tapered edges. In accordance with example embodiments, the instrument can be a string instrument that includes a body. For example, the instrument can be a guitar and the board can be configured to define a perimeter substantially similar to the rear face of the body of the guitar.

Stand portion 14 can be a leg and can be defined by the board. The leg can be moveable between at least two positions with respect to the board. The first of the two positions can include the leg being received within the board to complete the board. The second of the two positions can include the leg being extended from the board to form a support for the musical instrument.

Both backing 12 and stand 14 can have approximately the same thickness, and stand 14 can extend beyond the lower perimeter of backing 12 at the lower edge. Backing 12 can extend above the upper perimeter of stand 14 and backing 12 can provide a perimeter extending almost completely encompassing stand 14. Both stand 14 and backing 12 can be constructed of a lightweight polymeric material having a thickness of from about 1/16 to about 1/4 of an inch; from about 1/16 to about 1/8 of an inch; or from about 1/8 to about 1/4 of an inch. Stand 14 and/or backing 12 can also be constructed of other non-polymeric materials as well such as wood or metal for example. While backing 12 can at least partially conform to the perimeter of the body of the instrument, stand 14, while be received by the backing may extend beyond the perimeter of the instrument a sufficient amount to expose an amount of the stand beyond the sidewall of the body of the instrument. In accordance with example embodiments, this exposed portion can be exploited to move the stand from the first position biased against the instrument body to the second position biased to support the instrument.

In accordance with example implementations, the backing and stand can encompass a majority of the surface area of the rear face of the instrument. Backing 12 can conform to the surface area of the rear face as well. For example, flat surfaces as well as concave and/or convex surfaces can be conformed to as well. In combination or individually, backing 12 and stand 14 can prevent the damage of the rear surface of an instrument by providing a guard over the rear surface. The depth of backing 12 and stand 14 can allow for the accessory and instrument both to be stored in a case for the instrument. Accordingly, when coupled to the instrument, the accessory can encompass such little space that the instrument case can be used to house/transport/protect the instrument.

Included with accessory 10 is edge 16 which can be separate and apart from stand 14. Edge 16 likewise can have the similar thickness to backing 12 and stand 14 and can have a portion that extends at an angle normal to that of backing 12 and/or stand 14. Edge 16 can be considered a trigger, and in accordance with example implementations, accessory 10 can include the trigger. The trigger can include at least two elements defining a corner and lever pivotally engaged with the corner. The lever can be moveable between a first position having a portion thereof extending from one element of the corner and a second position having a portion thereof extending from the other element of the corner. In accordance with example aspects, the leg can be biased in the first position as described above and moving the lever from its first position to its second position can release the bias and move the leg from its first position to its second position.

Figure 2:
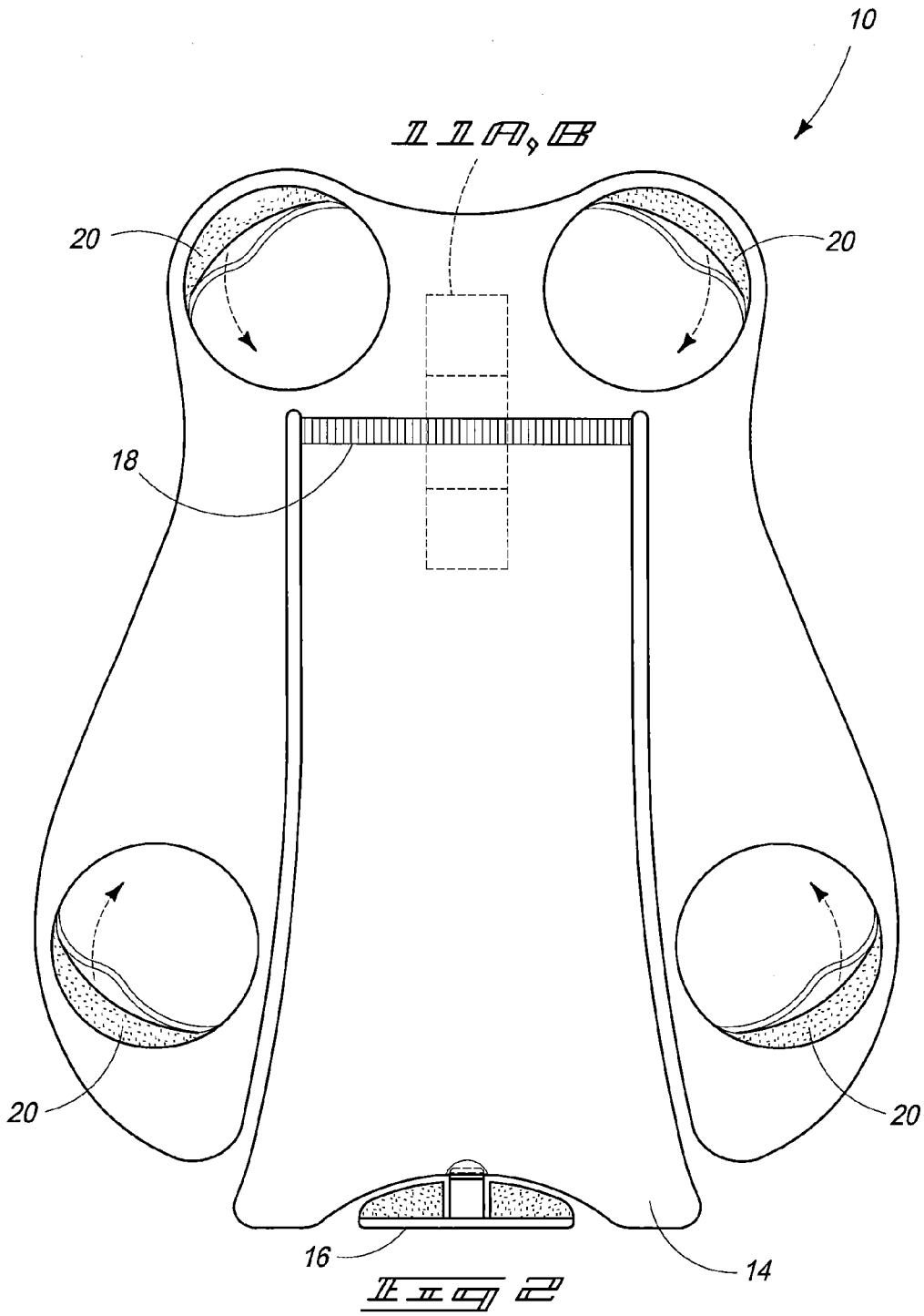
FIG. 2 is another view of the musical accessory of FIG. 1 according to an embodiment.

Referring next to FIG. 2, on an opposing side of accessory 10 can be found coupling portions 20 placed at far edges of backing 12. According to example implementations, these coupling portions can be quick safe glue portions that are protected by peel-away covers prior to being adhered to the body of a musical instrument. In accordance with example implementations, the coupling portions can be circular in shape and can extend to within edges of backing portion 12. The safety glue portions can include but are not limited to 3M and/or DAP products. Backing portion 12 can be considered adhesion points and in accordance with example implementations, the board can include at least four adhesion points. These adhesion points can each be placed proximate a different corner of the board.

In accordance with example methods, the board of accessory 10 can be adhered to the rear face of the musical instrument. The musical instrument may be stored within its case, and/or the musical instrument may be supported by the leg of accessory 10. Example methods can also include adhering a trigger to a rear facing edge of the instrument opposing the neck. In accordance with example implementations, releasing the leg from its first position to its second position can include engaging the trigger. The trigger may be engaged by placing a portion, for example, the lever, of the trigger against a substantially fixed substrate. The placing can release the bias and allow the leg to move toward its second position.

Figures 3, 4, 4A:
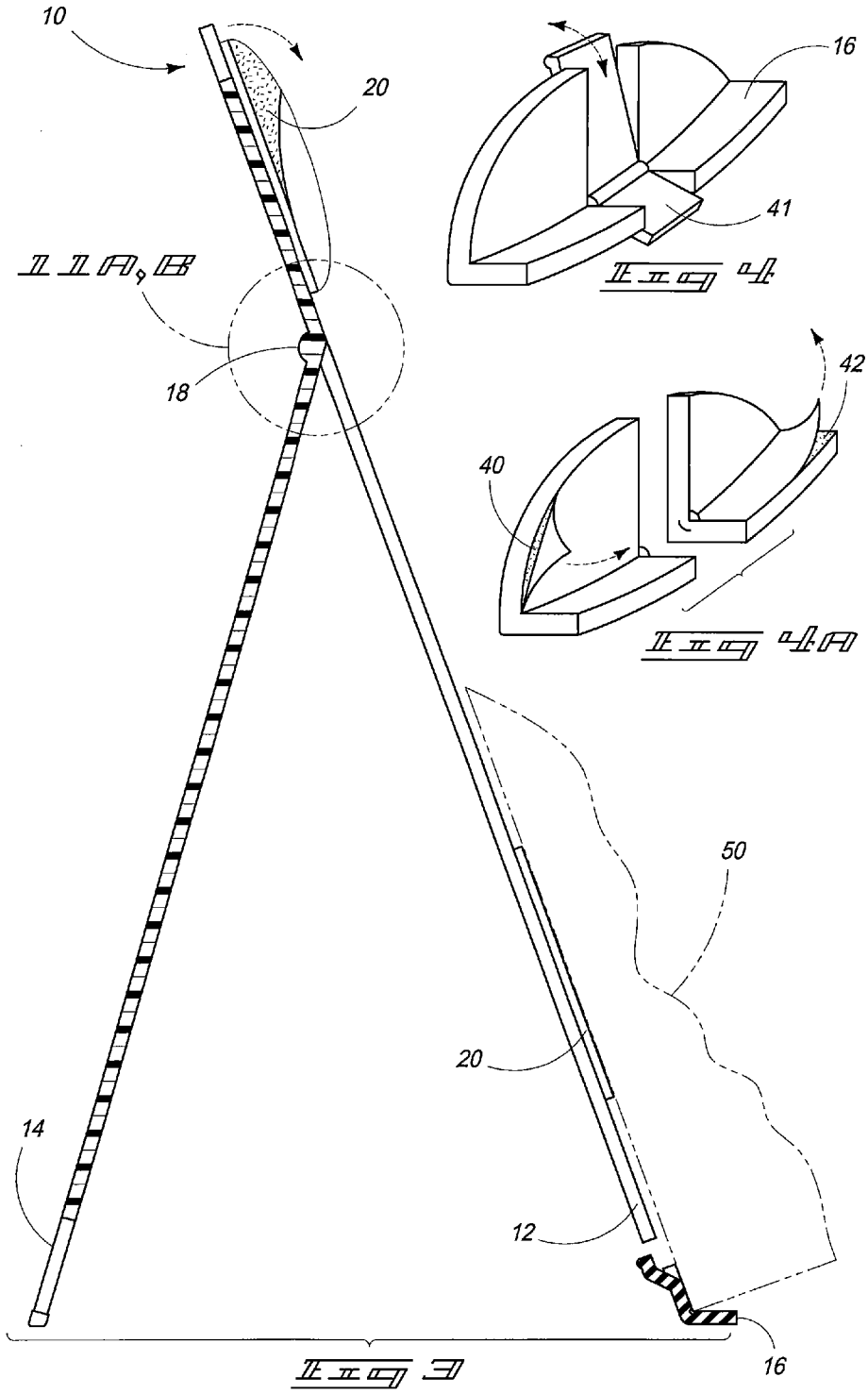
FIG. 3 is a musical accessory according to an embodiment.
FIGS. 4 and 4A are components of a musical accessory according to an embodiment.

Referring next to FIG. 3, a cross-section of accessory 10 is shown coupled to a musical instrument. In accordance with this example implementation, hinge 18 can couple stand 14 to backing 12 and in this view, stand 14 is in a position extended away from backing 12 with the position allowing for the support of a musical instrument. As depicted, edge 16 can protect the bottom edge of the musical instrument in this one position as the musical instrument is in the standing position.

Referring to FIGS. 4 and 4A, example implementations of edge 16 are shown. In one implementation, edge 16 includes a biased trigger that upon the resting of the bottom portion of the instrument, it extends to move stand 14 from a closed position to an open end standing position. In accordance with example configurations, stand 14 can be bias to exist in the open position and the trigger of edge 16 can be bias to reside against the body of the instrument with a portion of the trigger extending beyond the bottom edge and/or outside the perimeter defined by the back surface of the instrument. Accordingly, the portion of the trigger within the perimeter may overlap with perimeter of stand 14 when the stand resides against the instrument. In certain implementations, this portion of the trigger can retain stand 14 in the collapsed position with stand 14 residing against at least a portion of the back of the instrument.

In accordance with example methods, with stand 14 restrained against the back of the instrument by the portion of the trigger, the user can place the lower portion of the instrument against a substrate such as a floor. Upon placing the extended trigger portion against the floor, the upper portion of the trigger proceeds away from the back surface of the instrument releasing stand 14 and allowing stand 14 to extend to its biased position in the instrument supporting configuration.

In accordance with example implementations and in referencing FIG. 4, edge 16 can have coupling portions 42 and 40 that may be safety glue coupling portions as described with reference to backing 12. In accordance with other implementations, edge 16 can conform to a lower sidewall and rear face of the body of the instrument. Edge 16 can be provided without a trigger. In accordance with a triggerless embodiment, edge 16 can protect the instrument from damage when it is in the supported position. In accordance with other implementations, edge 16 may only extend along a sidewall of the instrument body, leaving the rear face of the body exposed.

Figure 5:
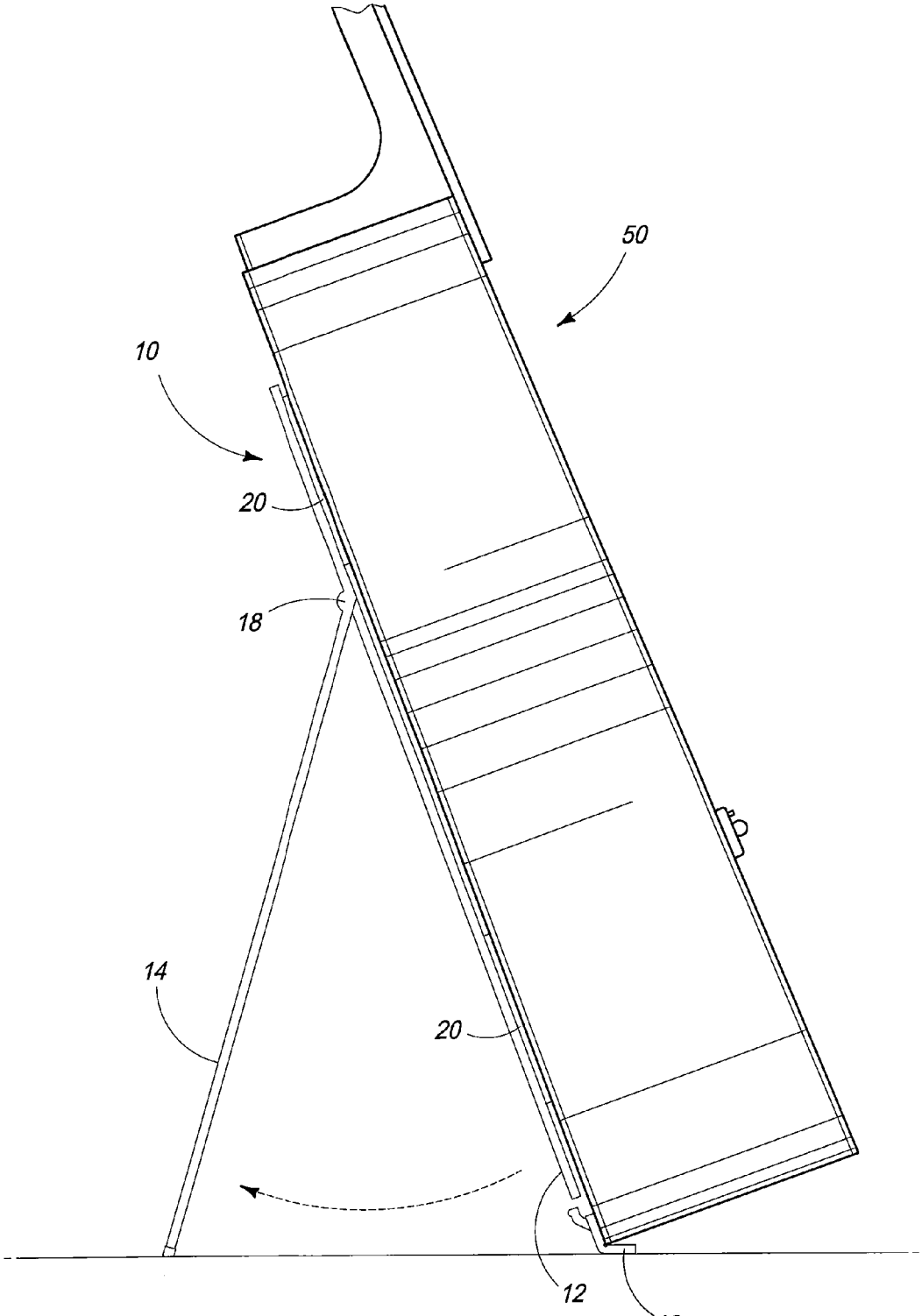
FIG. 5 is an instrument having a musical accessory coupled thereto according to an embodiment.

Referring next to FIG. 5, accessory 10 is shown placed on an instrument 50 having stand 14 in the open position with backing 12 supporting instrument 50.

Figure 6B:
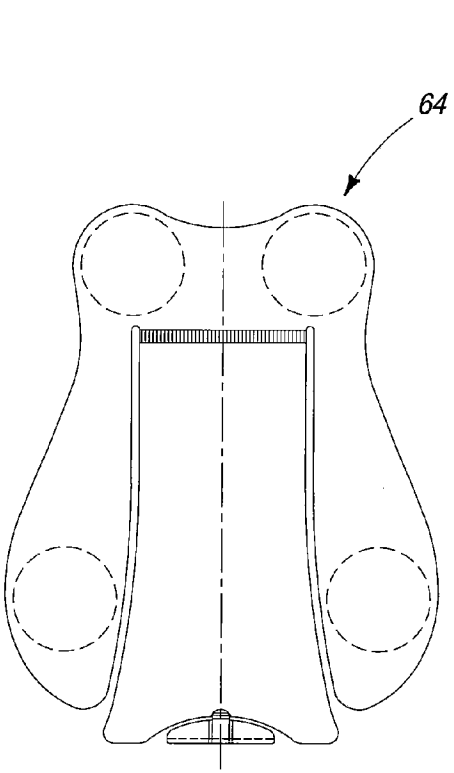
FIGS. 6, 6A and 6B are embodiments of musical accessories according to embodiments.
Figure 6A:
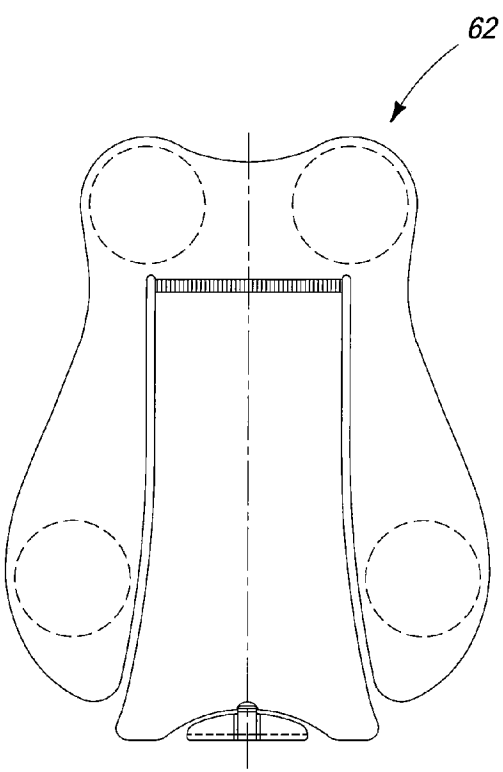
Figure 6:
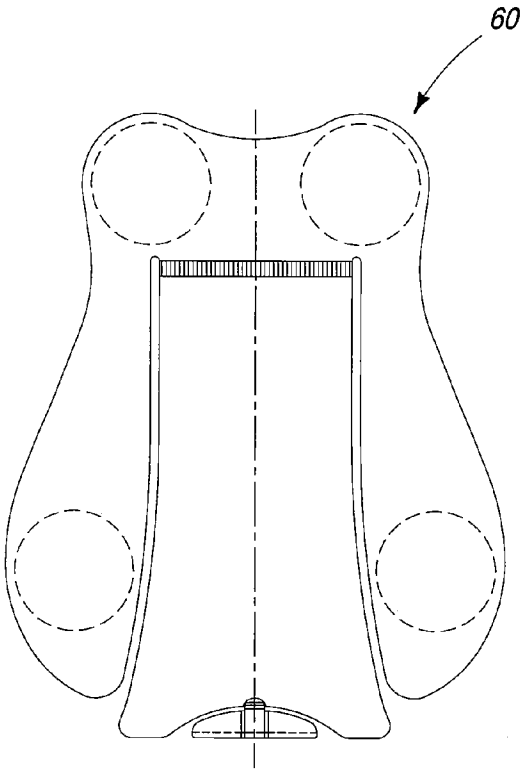
Figure 7:
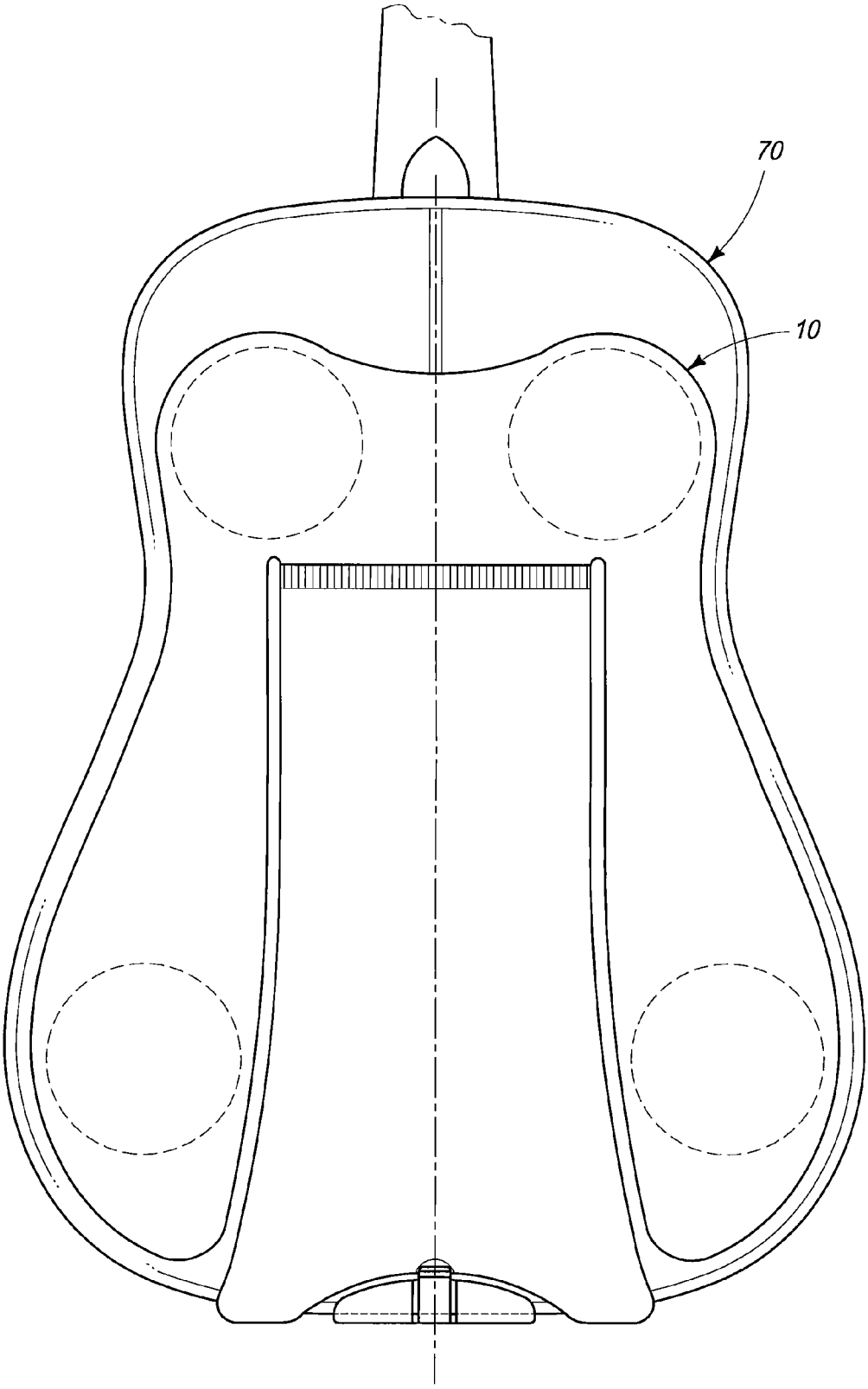
FIG. 7 is an instrument having a musical accessory coupled thereto according to an embodiment.
Figure 8:
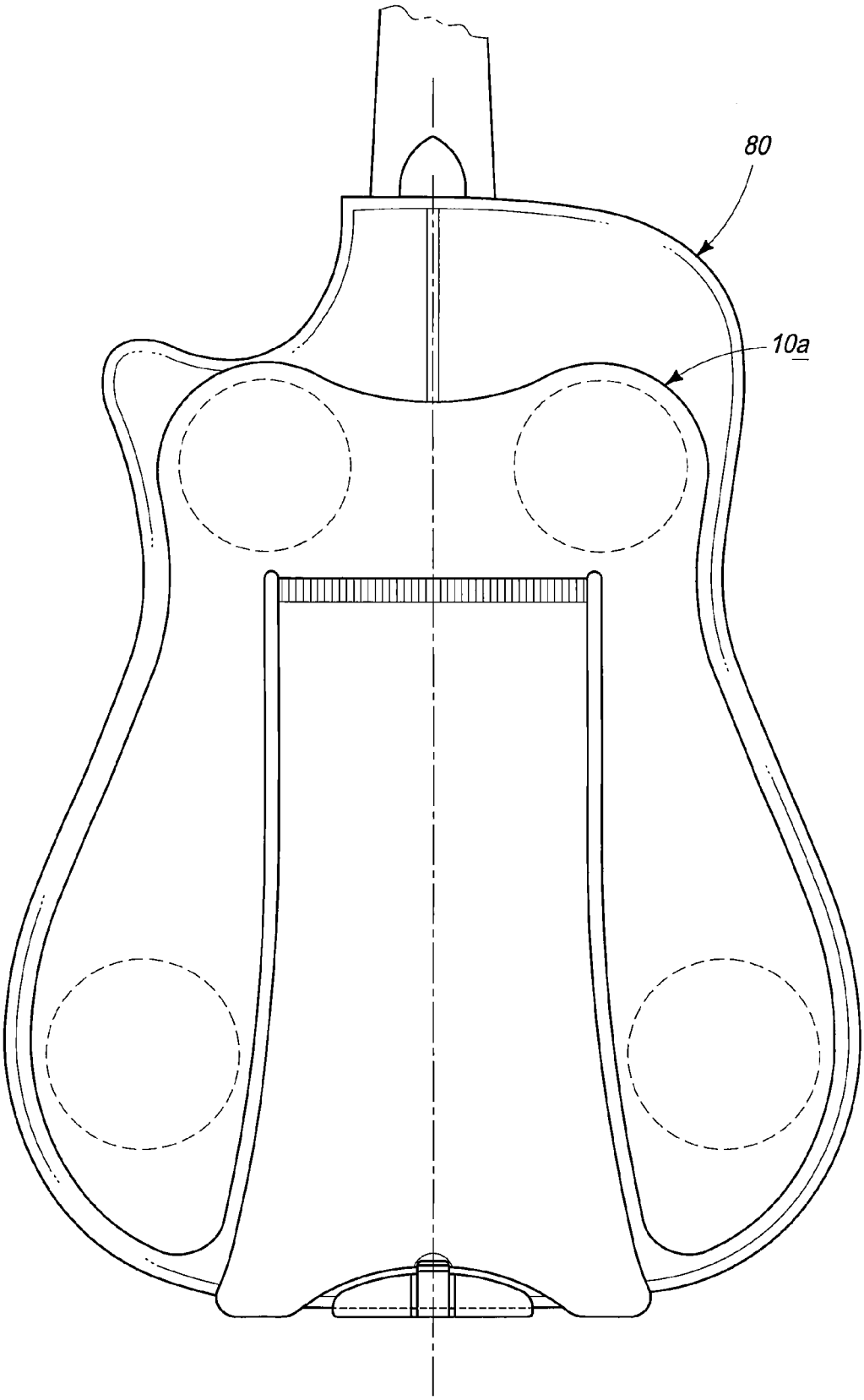
FIG. 8 is a musical instrument having a musical accessory coupled thereto according to an embodiment.
Figure 9:
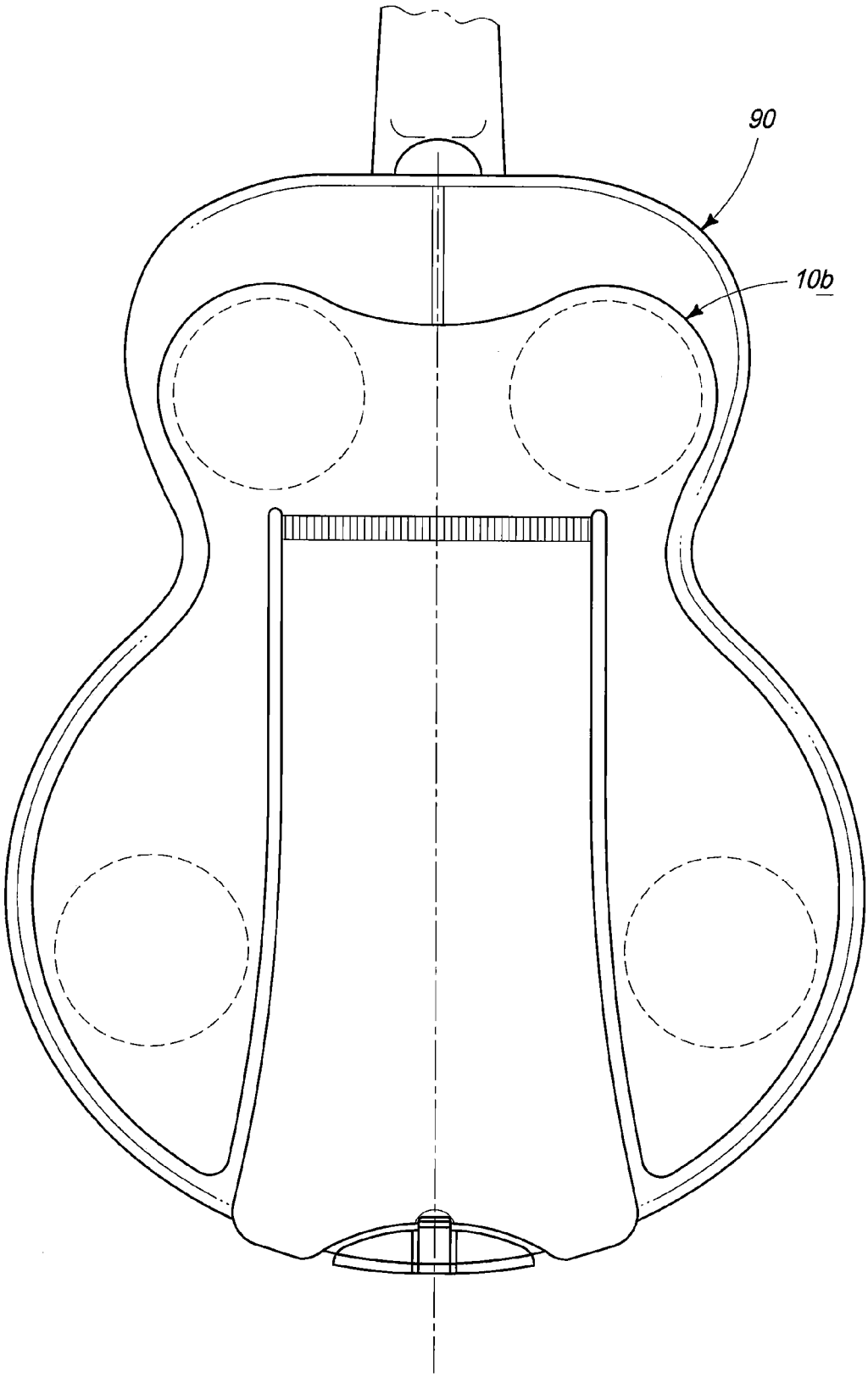
FIG. 9 is a musical instrument having a musical accessory coupled thereto according to an embodiment.
Figure 10:
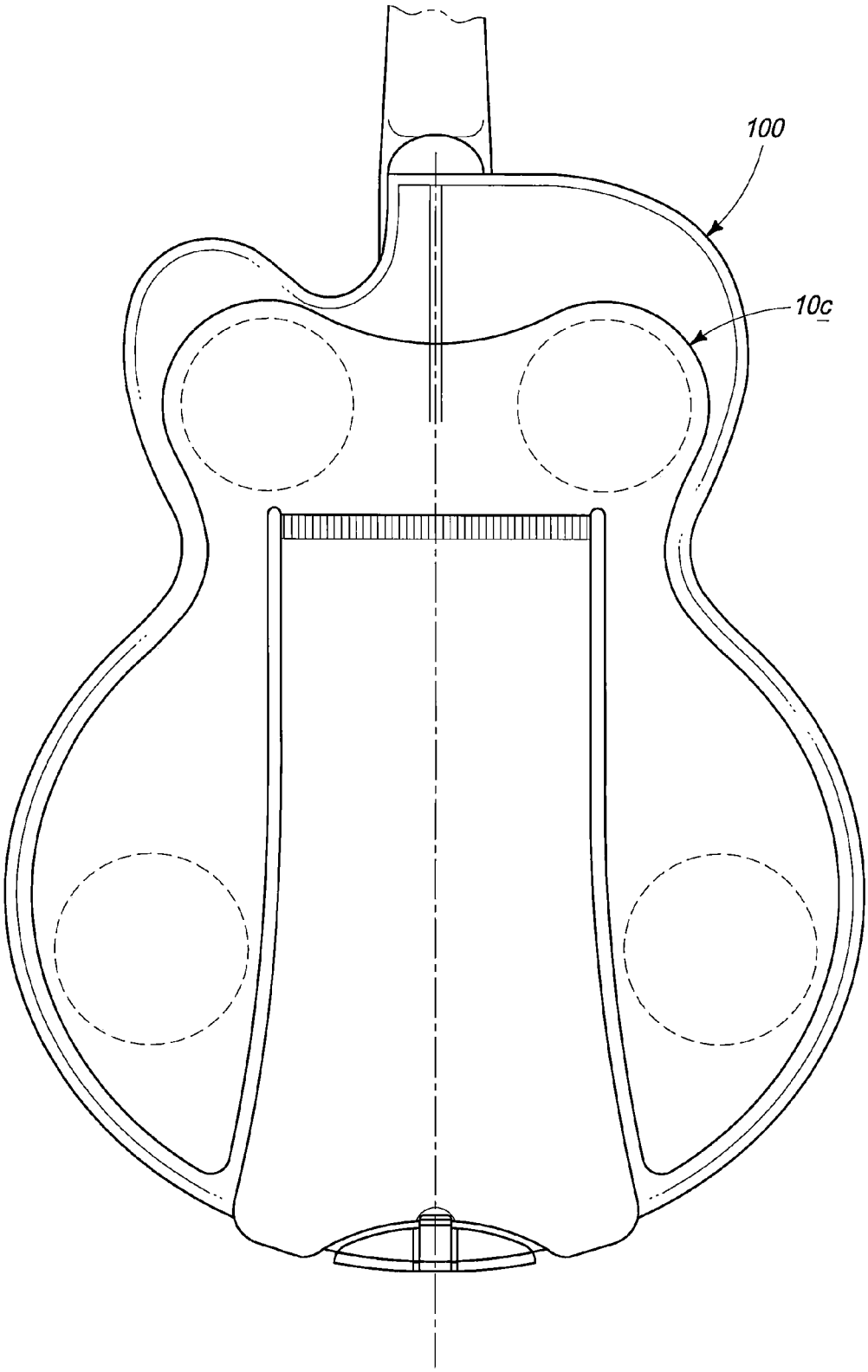
FIG. 10 is a musical instrument having a musical accessory coupled thereto according to an embodiment.

Referring to FIGS. 6-6B, embodiments of the musical accessory are shown with reference to embodiments 60, 62, and 64. As shown, the accessory can take a form or shape desired to meet various musical instrument shapes and sizes. For example, with reference to FIG. 7, accessory 10 is shown on the back of an acoustic dreadnought body style musical instrument. With reference to FIG. 8, accessory 10A is shown on the rearward portion of an acoustic dreadnought cutaway instrument 80. With reference to FIG. 9, accessory 10B is shown on the rearward side of an acoustic jumbo or round-body musical instrument 90, and with reference to FIG. 10, accessory 10C is shown on the rearward portion of acoustic jumbo cutaway instrument 100.

Figure 11A:
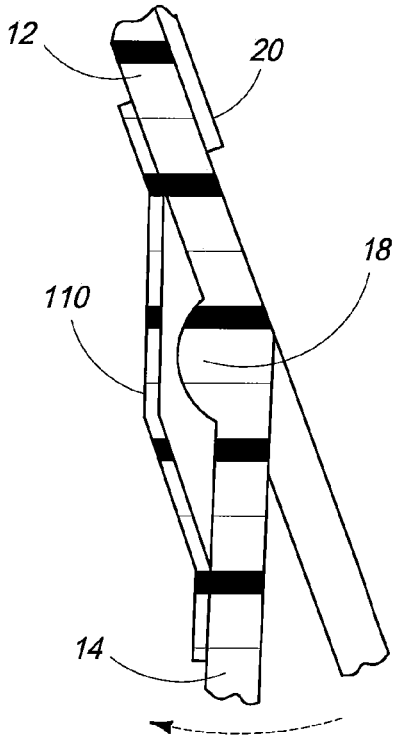
FIGS. 11A and 11B are the musical accessory in first and second positions according to embodiments.
Figure 11B:
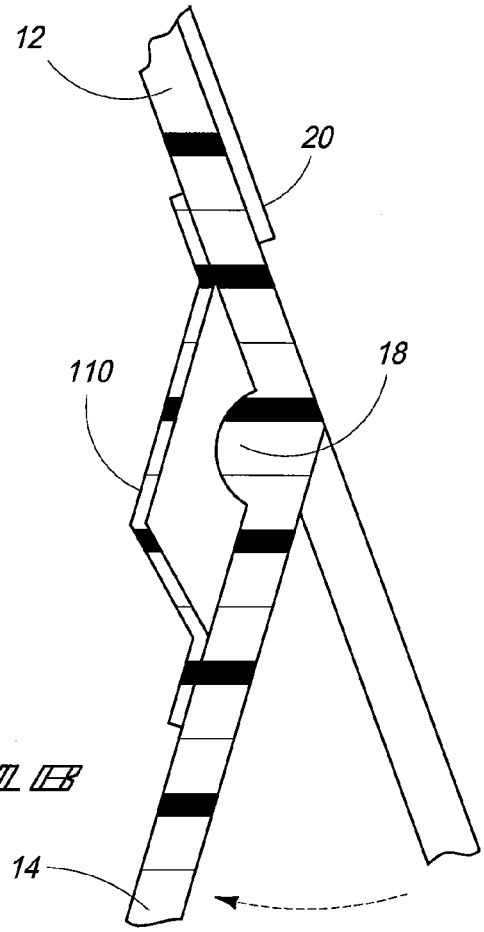

Referring next to FIGS. 11A and 11B, a more detailed view of hinge 18 of accessory 12 is shown with biasing member 110 in place. According to example implementations, biasing member 110 can include a portion of biasing material that provides for the biasing of stand 14 in either an open or closed position. As shown in FIG. 11A, biasing member 110 is shown with stand 14 approaching the open position, and in FIG. 11B biasing member 110 is shown with stand 14 in the open or upright or standing position.

In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect. The invention is, therefore, claimed in any of its forms or modifications within the proper scope of the appended claims appropriately interpreted in accordance with the doctrine of equivalents.

What is claimed is:

1. A musical instrument accessory comprising:

a substantially planar board at least partially complementing the rear face of the musical instrument;

a portion of the board defining at least one substantially planar leg coupled to the board and moveable between at least two positions with respect to the board, the first position wherein the leg is received within the board to complete the board, and the second position wherein the leg is extended from the board to form a support for the musical instrument;

one or more adhesion elements along one side of the board; and a leg trigger, the trigger comprising at least two elements defining a corner and lever pivotally engaged with the corner, the lever moveable between a first position having a portion thereof extending from one element of the corner and a second position having a portion thereof extending from the other element of the corner.

2. The musical instrument accessory of claim 1 wherein the board defines a perimeter and at least a portion of the perimeter comprises tapered edges.

3. The musical instrument accessory of claim 1 wherein the musical instrument is a string instrument and includes a body.

4. The musical instrument accessory of claim 1 wherein the musical instrument is a guitar and the board is configured to define a perimeter substantially similar to the rear face of the body of the guitar.

5. The musical instrument accessory of claim 1 wherein the accessory includes at least four adhesion points each placed proximate a different corner of the board.

6. The musical instrument accessory of claim 1 wherein the leg is biased in the first position and moving the lever from the first position to the second position releases the bias and moves the leg from the first position to the second position.

7. The musical instrument accessory of claim 1 wherein the board and the leg are of substantially the same thickness.

8. The musical instrument accessory of claim 1 wherein the thickness is from about 1/16 to about 1/4 of an inch.

* * * * *